US009160099B2

(12) United States Patent
Pfiffi

(10) Patent No.: US 9,160,099 B2
(45) Date of Patent: Oct. 13, 2015

(54) PLUG CONNECTOR

(75) Inventor: Horst Pfiffi, Queidersbach (DE)

(73) Assignee: Mobotix AG (DE)

( * ) Notice: Subject to any disclaimer, the term of this patent is extended or adjusted under 35 U.S.C. 154(b) by 115 days.

(21) Appl. No.: 14/003,360

(22) PCT Filed: Mar. 8, 2012

(86) PCT No.: PCT/DE2012/000224

§ 371 (c)(1),
(2), (4) Date: Dec. 10, 2013

(87) PCT Pub. No.: WO2012/119587

PCT Pub. Date: Sep. 13, 2012

(65) Prior Publication Data

US 2014/0159320 A1 Jun. 12, 2014

(30) Foreign Application Priority Data

Mar. 9, 2011 (DE) ..... 10 2011 013 452
Mar. 14, 2011 (DE) ..... 10 2011 014 012

(51) Int. Cl.

| | |
|---|---|
| ***H01R 24/64*** | (2011.01) |
| ***H01R 13/52*** | (2006.01) |
| *H01R 13/516* | (2006.01) |
| *H01R 13/533* | (2006.01) |

(52) U.S. Cl.

CPC ..... *H01R 13/5221* (2013.01); *H01R 13/5205* (2013.01); *H01R 24/64* (2013.01); *H01R 13/516* (2013.01); *H01R 13/533* (2013.01)

(58) Field of Classification Search

CPC ..... H01R 24/64
See application file for complete search history.

(56) References Cited

U.S. PATENT DOCUMENTS

| | | | | | |
|---|---|---|---|---|---|
| 2,958,845 | A | * | 11/1960 | Dupre et al. | 439/585 |
| 3,449,706 | A | * | 6/1969 | Carissimi | 439/141 |
| 4,290,664 | A | * | 9/1981 | Davis et al. | 439/638 |
| 4,477,141 | A | * | 10/1984 | Hardesty | 439/535 |
| 4,684,198 | A | * | 8/1987 | Becraft et al. | 439/571 |
| 4,932,882 | A | * | 6/1990 | Kang | 439/22 |
| 5,143,868 | A | * | 9/1992 | Caveney et al. | 439/535 |
| 5,378,882 | A | * | 1/1995 | Gong et al. | 235/462.45 |
| 5,538,438 | A | * | 7/1996 | Orlando | 439/344 |
| 5,701,355 | A | * | 12/1997 | Brannan et al. | 381/361 |
| 5,886,294 | A | * | 3/1999 | Scrimpshire et al. | 174/359 |
| 5,898,789 | A | * | 4/1999 | Nichols et al. | 381/361 |
| 6,080,001 | A | * | 6/2000 | Wong | 439/344 |
| 6,409,532 | B2 | * | 6/2002 | Payson et al. | 439/320 |
| 6,429,373 | B1 | * | 8/2002 | Scrimpshire et al. | 174/74 R |
| 6,435,911 | B1 | * | 8/2002 | Payson et al. | 439/606 |
| 6,475,009 | B2 | * | 11/2002 | Below et al. | 439/271 |
| 6,482,017 | B1 | * | 11/2002 | Van Doorn | 439/89 |
| 6,520,796 | B1 | * | 2/2003 | Reichle | 439/491 |

(Continued)

FOREIGN PATENT DOCUMENTS

| | | |
|---|---|---|
| DE | 20 2005 002 162 | 4/2005 |
| EP | 1 317 025 | 6/2003 |

(Continued)

*Primary Examiner* — Ross Gushi
(74) *Attorney, Agent, or Firm* — Salter & Michaelson

(57) ABSTRACT

A seal for a plug connector arrangement having a plug which is intended to latch into a standard socket in a releasable manner, wherein the seal is formed with a latching suppression means for permanently preventing the plug from latching in and with a pushing means for pushing the plug, which is not latched in, into its standard contact position.

13 Claims, 3 Drawing Sheets

(56) References Cited

U.S. PATENT DOCUMENTS

| | | | | |
|---|---|---|---|---|
| 6,582,248 | B2 * | 6/2003 | Bachman | 439/462 |
| 6,595,791 | B2 * | 7/2003 | Below et al. | 439/271 |
| 6,817,902 | B2 * | 11/2004 | Bernardi et al. | 439/676 |
| 6,916,203 | B2 | 7/2005 | Oyamada et al. | |
| 6,969,279 | B1 * | 11/2005 | Mahoney | 439/589 |
| 7,074,066 | B2 * | 7/2006 | Pepe | 439/321 |
| 7,097,486 | B2 * | 8/2006 | Parsons | 439/291 |
| 7,163,414 | B2 * | 1/2007 | Lo et al. | 439/352 |
| 7,175,459 | B2 * | 2/2007 | Milner et al. | 439/271 |
| 7,234,877 | B2 * | 6/2007 | Sedor | 385/71 |
| 7,303,418 | B2 * | 12/2007 | O'Connor | 439/277 |
| 7,316,583 | B1 * | 1/2008 | Mistarz et al. | 439/589 |
| 7,367,832 | B2 * | 5/2008 | Muhs et al. | 439/318 |
| 7,367,848 | B2 * | 5/2008 | John | 439/676 |
| 7,527,515 | B1 * | 5/2009 | Olson et al. | 439/352 |
| 7,767,908 | B2 * | 8/2010 | Sylvan | 174/74 R |
| 7,841,881 | B2 * | 11/2010 | Hsu et al. | 439/277 |
| 7,909,625 | B2 * | 3/2011 | Obenshain | 439/133 |
| 7,988,476 | B2 * | 8/2011 | Billman et al. | 439/271 |
| 8,025,519 | B2 * | 9/2011 | Handshaw et al. | 439/352 |
| 8,038,460 | B2 * | 10/2011 | Andres et al. | 439/344 |
| 8,202,008 | B2 * | 6/2012 | Lu et al. | 385/53 |
| 8,262,406 | B2 * | 9/2012 | Lindkamp | 439/470 |
| 8,376,628 | B2 * | 2/2013 | Koreeda et al. | 385/75 |
| 8,480,428 | B1 * | 7/2013 | Sper et al. | 439/521 |
| 8,529,288 | B2 * | 9/2013 | Montena et al. | 439/523 |
| 8,573,853 | B2 * | 11/2013 | Ordo et al. | 385/53 |
| 8,651,889 | B2 * | 2/2014 | Krech | 439/367 |
| 8,672,705 | B2 * | 3/2014 | Schneider | 439/460 |
| 8,757,899 | B2 * | 6/2014 | Hattori | 385/92 |
| 8,814,608 | B2 * | 8/2014 | Song et al. | 439/814 |
| 2001/0036762 | A1 * | 11/2001 | Payson et al. | 439/320 |
| 2003/0148652 | A1 * | 8/2003 | Bernardi et al. | 439/462 |
| 2005/0064752 | A1 * | 3/2005 | Serino | 439/320 |
| 2006/0035508 | A1 * | 2/2006 | Stekelenburg | 439/369 |
| 2006/0035509 | A1 * | 2/2006 | O'Connor | 439/369 |
| 2006/0068625 | A1 | 3/2006 | Kim et al. | |
| 2006/0166554 | A1 * | 7/2006 | Hung | 439/589 |
| 2008/0132101 | A1 * | 6/2008 | Gundlach et al. | 439/266 |
| 2009/0148101 | A1 * | 6/2009 | Lu et al. | 385/56 |
| 2009/0202207 | A1 * | 8/2009 | Grzegorzewska et al. | 385/88 |
| 2010/0266242 | A1 * | 10/2010 | Lu et al. | 385/53 |
| 2012/0214335 | A1 * | 8/2012 | Natoli et al. | 439/519 |
| 2015/0017827 | A1 * | 1/2015 | Vaccaro | 439/275 |

FOREIGN PATENT DOCUMENTS

| | | |
|---|---|---|
| EP | 1 662 287 | 5/2006 |
| FR | 2 906 089 | 3/2008 |

* cited by examiner

PLUG CONNECTOR

TECHNICAL FIELD

The present invention relates to the subject matter claimed in the preamble and therefore concerns sealing off plug connectors.

BACKGROUND OF THE INVENTION

Plug connectors are used to connect electrical devices. To this end, a socket is typically provided on the device, it being possible for a suitable plug to be inserted into said socket. A large number of different standards for socket/plug pairs are known in this case. Although socket/plug pairs of this kind cannot be as large as desired, it is equally necessary to ensure that the inserted plug exhibits a sufficiently large pull-out force, that is to say cannot be easily removed from the associated socket. This can be achieved, for example, by way of latching elements which, after the plug is inserted, allow said plug to be pulled out only after the latching lock is released.

Examples include plugs which comply with standard RJ45 and are widely used in network engineering in particular. Said plugs have an approximately cuboid front region, a plurality of electrical contacts are provided parallel to one another on the lower face of said region and a latching arm is situated on the upper face of said region, this latching arm initially being pressed downward when the plug is inserted into the socket, until it is pushed behind a latching stop where it is pivoted back into its latching position away from the plug body. In order to remove the plug from the socket, an attachment on the latching element, which attachment projects out of the socket, has to be pressed against the body, this pivoting the latching means downward out of the latching position and allowing the plug to be pulled out.

The known plugs of this kind are widely used and are also produced in an economical manner as mass-produced products. However, although known plugs of this kind are standardized in terms of sockets, they are provided with different plug grip bodies which are not standardized. A problem therefore arises when the arrangement is exposed to the elements. It is then necessary to provide an arrangement which is resistant to weathering.

It is desirable, in the process, for it to be possible for conventional cables to be used so that electrical devices which are intended to be connected by means of known plugs of this kind and which are exposed to the elements can be connected independently of the required length of the lines.

The object of the present invention is to provide a novel subject matter for industrial use.

The way in which this object is achieved is claimed in independent form.

SUMMARY OF THE INVENTION

The present invention is therefore concerned with a seal for a plug connector arrangement having a plug which is intended to latch into a standard socket in a releasable manner, with provision being made for the seal to be formed with a latching suppression means for permanently preventing the plug from latching in and with a pushing means for pushing the plug, which is not latched in, into its standard contact position.

A first basic idea of the present invention is therefore that the latching-in means can be easily rendered inoperative if the seal, when in use, ensures that the plug remains in its correct contact position. This allows an adequate leaktight connection which affords good protection against atmospheric moisture, driving rain etc., without being adversely affected by the latching means.

It is possible and preferred to use the seal of the present invention for a plug which, as a standardized element, has only a front, cuboid or block-like region which has contact elements, in particular on its lower face, and is provided with the latching means on its upper face, as is the case in plugs which comply with the standard RJ45, while the plug grip body can be formed in a conventional manner without any particular restriction which requires that conventional grip body sizes be complied with. However, it should be noted that the invention is in no way restricted to RJ45 plugs but rather other modular plugs, such as RJ21 plugs and the like, can also be used, in particular. Modular plugs of this kind, for example including those which comply with the standards RJ11, RJ14 and RJ12, share the common feature that they have a block-like front region in which contacts are arranged on one face and the latching element is formed on the other face of said front region as an articulated arm which protrudes in the unloaded state and enters the socket behind a latching stop and thus prevents said plug from being pulled out, provided that the latching arm is not pressed against the body.

The sealing sleeve is produced separately from the plug, preferably from a highly flexible material. The plug, particularly in the case of modular plugs, is generally wider than the cable which is connected by it. In this case, the preferred flexibility of the sealing sleeve is so great that a prefabricated plug may possibly also be inserted into the sealing sleeve from the rear face, that is to say through the opening which surrounds the cable in a sealing manner during use. This allows the flexible sealing sleeve of a seal according to the invention to be slipped over a prefabricated plug and thus render the prefabricated cable serviceable.

In a preferred variant, the latching prevention means will not simply engage with the latching means at any location but preferably, at least in that position in which the separating means pushes into the socket, also stop on the latching element in a clearly defined position. To this end, when the plug is in the form of a modular plug, projections are provided on the latching prevention means on both sides of the operating arm for the latching means, said projections butting against those edges which bear against the latching shoulders when the latching cable is used in a conventional manner. In this way, it is easily possible to ensure that the plug enters a standard contact position, irrespective of the latching means being rendered inoperative, simply by the pushing means again making fixed contact with the latching prevention means. According to the invention, the correct position of the plug in the socket will ensure the standard position of the plug, irrespective of the latching prevention, specifically by the latching prevention means.

It is possible and preferred for the pushing means to comprise a threaded or bayonet nut which can be turned in order to be fitted to a fastening means on the housing having the socket. In this way, mounting and removal can be performed in a particularly simple manner. As an alternative, a refinement is possible, for example, in such a way that the plugs are inserted in a linear manner and are fixed to the housing with a latching hook. This latching hook arrangement can be designed such that it can be released with or without tools.

Protection is also claimed for a plug connection having a seal according to the invention and also for an electrical device which is designed for use with the seal according to the invention.

DESCRIPTION OF THE DRAWINGS

The invention will be described in the text which follows merely by way of example with reference to the drawings in which.

DETAILED DESCRIPTION

Figure 2:
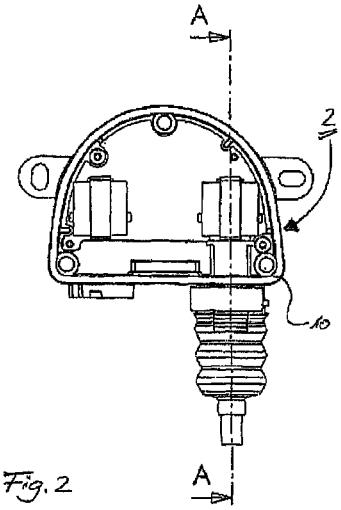
FIG. 2 shows a plan view of the opened housing from FIG. 1 with the plug inserted.
Figure 1:
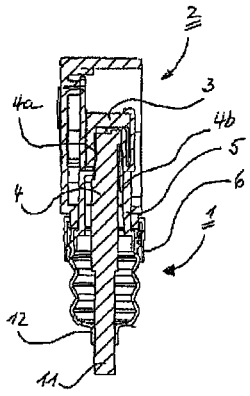
FIG. 1 shows a plug connector having a seal according to the present invention in the installed state in a housing.
Figure 3:
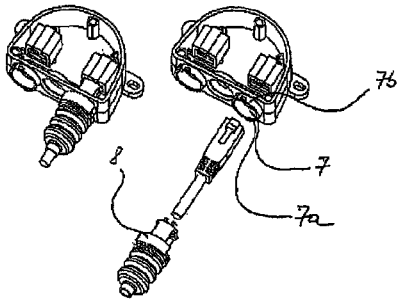
FIG. 3 shows a perspective illustration of a seal according to the invention having a plug, which is still shown separately from said seal, and having a housing.

According to FIG. 1, a seal 1, which is designated 1 in general, for a plug connector arrangement 2 having a plug 4 which can latch into a standard socket 3 in a releasable manner comprises a latching suppression means 5 for permanently preventing the plug 4 from latching into the socket and comprises a pushing means 6 for pushing the plug 4, which is not latched in, into its contact position 2 during use.

In the present case, the seal 1 is designed to fit the plug to a housing 10 such that said plug is protected against atmospheric influences such as moisture, driving rain and the like.

The plug connector arrangement 2 is a modular plug which is conventional per se and here is illustrated as an RJ45 plug, as is preferred. While the housing 10 shown has only 2 connections and one way of being fastened to a wall, and therefore can serve as a coupling for example, it is clear that the plug connector arrangement 2 can also be easily fitted in an electrical device which is operated outdoors, for example a surveillance camera. In this case, it is preferred for the inlet opening 7 for the plug 4 to point downward during use when it is mounted in the expected manner.

The standard socket 3 of the RJ45 plug connector arrangement 2 illustrated here is positioned in the housing at a distance from the inlet opening 7 for the plug, which inlet opening is arranged in the wall of the housing 10.

The plug connector arrangement 2 is designed such that electrical contacts are provided on the lower face 4*a* of the plug, said electrical contacts engaging with mating contacts in the standard socket 3, with a latching means 4*b* being provided on the upper face, said latching means engaging with a pull-out lock in the standard socket 3 so as to prevent the plug from being pulled out, for example, in this case, the arm 4*b*1, which is articulated at one end, of the latching means 4*b*, provided that it is not pressed against the plug body 4*c*.

A conventional standard plug without a seal arrangement according to the invention can therefore be used with the housing 10 but may require the action of a tool in order to be released and, moreover, does not provide any leaktightness. However, it is at least possible to operate indoors without additional means or to temporarily operate without sealing means, for example for test purposes on a device which is already fitted.

The standard socket 3 for the modular plug is conventional per se and has mating contacts for the contacts on the plug 4 and also has a latching shoulder which hangs down and which can initially press the latching means 4*b*, which protrudes from the plug body in the relaxed state, down into the socket when the plug is inserted and, after complete insertion of the plug 4, allows the pressed-down latching means to relax so that the latching edge 4*b*2 and 4*b*2' of the latching means 4*b* moves behind the latching shoulder and thus blocks the plug against being pulled out.

Figure 5:
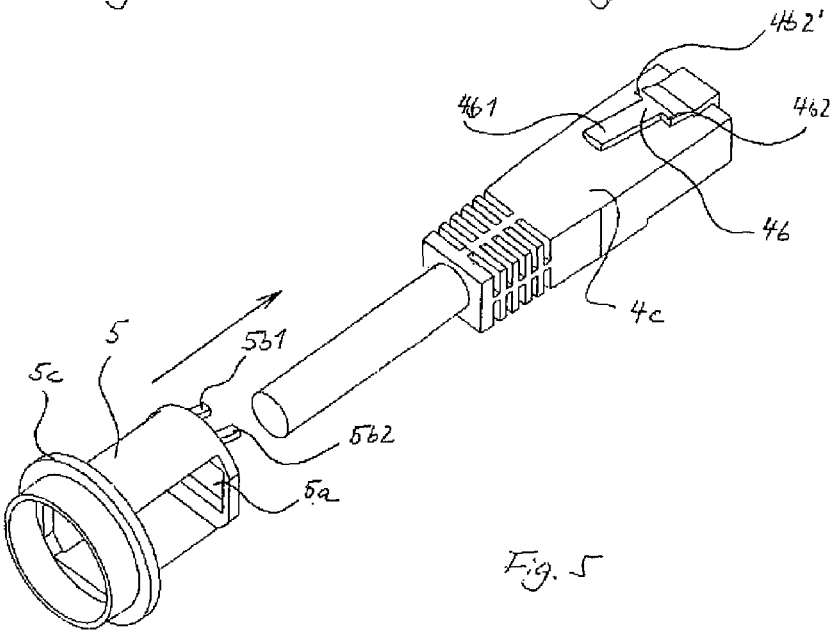
FIG. 5 illustrates the process of the latching suppression means stopping against the latching means.

The latching suppression means 5 is, cf. FIG. 5 in particular, in the form of a separate component through which the plug body can be pushed. Said latching suppression means has an opening 5*a* in the front end, this opening corresponding exactly to the standardized size of the block of the modular plug 4, and, protruding in front of the opening 5*a*, two attachments 5*b*1 and 5*b*2 which are dimensioned and arranged such that they stop against the latching edges 4*b*2' or 4*b*2 on both sides of the latching means arm 4*b*1 when the latching suppression means 5 is pushed forward from the cable end. The latching suppression means 5 has a length which is suitable for accommodating the customary grip body sizes of the modular body.

At the cable end, the latching suppression means 5 has an annular collar 5*c* which is designed to rest on a border 7*a* around the inlet opening 7.

The seal 1 also comprises a union nut 8 which, in the present case, is in the form of a bayonet nut and can be made to engage with a bayonet connection 7*b* about the inlet opening 7. The bayonet nut 8 is dimensioned such that a sealing sleeve 12 can be pushed on from the rear, said sealing sleeve engaging over the collar 5*c* and it being possible for said sealing sleeve to be pressed tightly against the housing together with the latching suppression means 5 by the pushing means 6 being screwed onto the bayonet thread of the housing 10.

The sealing sleeve 12 itself is formed from flexible material, in particular highly flexible plastic or rubber, and can be stretched to such a degree that the plug can be pushed through the sealing sleeve 12 of the seal 1, which sealing sleeve bears around the cable 11 during use, without damaging said seal.

Figure 4:
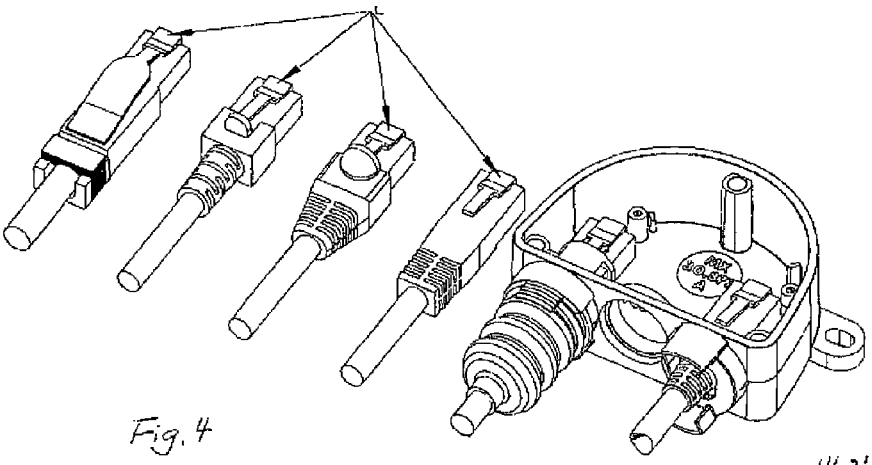
FIG. 4 shows various plugs of the present invention and a housing having a plug which is sealed according to the invention.

As can be seen from the comparison in FIG. 4 between the sealing sleeve and various conventional plug grip bodies which are depicted to the same scale, the sealing sleeve is formed to be so large that it can easily accommodate the portion of plug grip bodies which protrudes out of the housing 10.

The arrangement is used as follows:

The housing 10 is first mounted with the opening 7 which points downward being in the open air. A conventional RJ45 line is then provided and the cable is first plugged into the bayonet nut 8, through the rear face of the seal 1, and then through the latching suppression means 5. The seal is then slipped over the latching suppression means 5 and the bayonet nut 8 is slipped over the seal 1. This is done with the latching suppression means 5 already resting against the latching edges 4*b*2 and 4*b*2' by way of the lugs 5*b*1, 5*b*2. The latching means arm 4*b*1 is therefore pressed down. The plug 4 can now be pushed into the standard socket 3, said plug, however, not latching since the latching means 4 is pressed down. By virtue of fixing the bayonet nut 8 to the corresponding fastening means on the housing 10, the latching suppression means 5 is then pressed against the interior of the housing by suitable shaped portions in the internal region of the bayonet nut 8, this exerting force on the latching edges 4*b*1 and 4*b*2 via the lugs 5*b*1 and 5*b*2 and therefore driving the plug forward into the standard socket 3. In this case, a standard position is reached as a result of suitable selection of the spacing between the standard socket 3 and the opening 7 in the housing as soon as the bayonet is locked. This is the case irrespective of the shape of the plug grip body provided that customary sizes of the plug grip body are complied with; therefore, commercially available cables can be readily used, specifically even when reliable contact-connection is safety-critical. A sealing effect is achieved at the same time since the housing itself can be assumed to be leaktight, a seal is formed around the cable and sealing is also provided in the region around the border of the opening by the sealing sleeve being pressed against the housing by means of the collar 5*c*. The arrangement is therefore impermeable to atmospheric influences such as moisture and rain.

While a specific connection between the sealing sleeve and the nut, which is used for fixing the plug to the housing, or the like has been described above, this connection is not necessarily as described. Rather, other refinements are possible. This will be explained with reference to FIG. 6 which shows different refinements by way of example.

Figure 6:
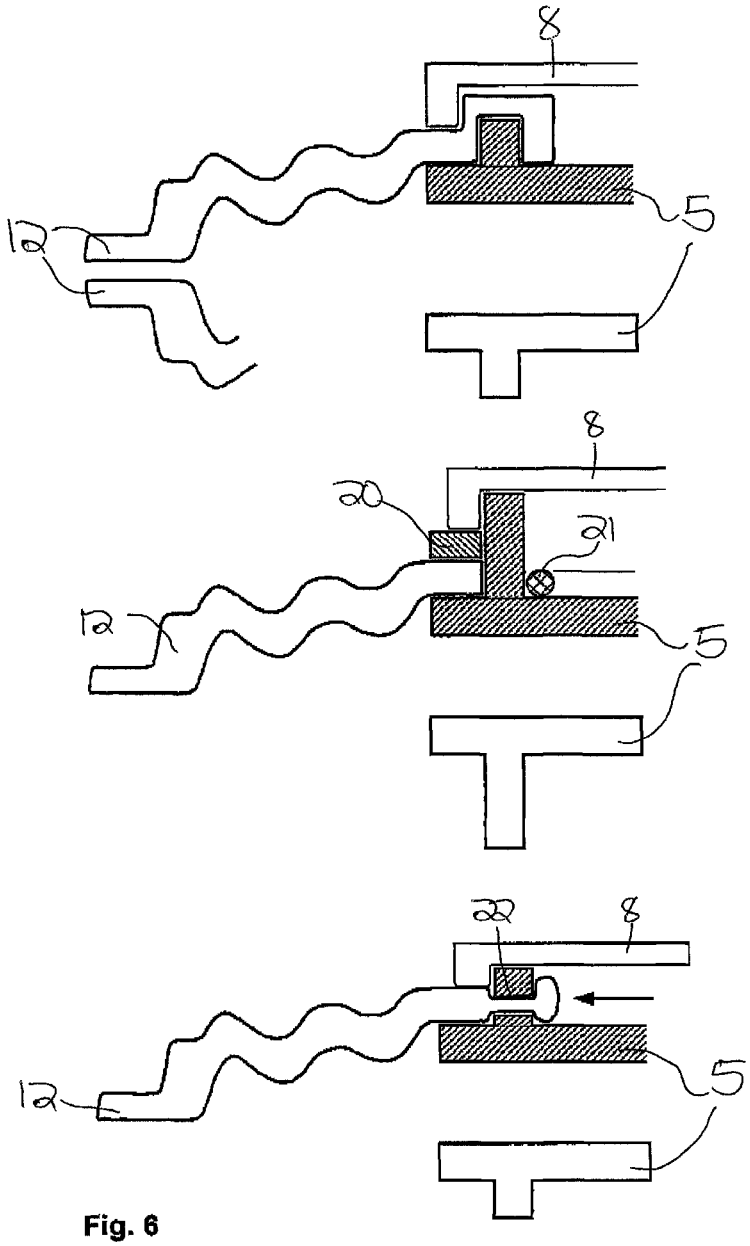
FIG. 6 shows various examples of the transition to the sealing sleeve.

The exemplary embodiment at the very top of FIG. 6 shows a sealing sleeve 12 which—as described above—engages over the collar of the insert 5, with the fastening means, which can be formed as a nut 8 for example, engaging over the collar. This arrangement has the advantage of simple production. However, one disadvantage of this variant is that the fastening means, for its part, is situated on the seal, this requiring the pull-out resistance to be relatively low where possible. In addition, when a nut is used, the nut also performs a rotary movement over the soft sealing sleeve, this possibly having an adverse effect on long-term stability.

The variant in the middle in FIG. 6 therefore makes provision for the sealing sleeve 12 to advance as far as the collar and there be fixed by a ring 20 which has been slipped on. The ring itself can be produced from hard plastic. The nut then makes contact only with this ring. In order to provide sealing with respect to the housing, that side of the collar which faces the housing can be provided with a sealing O-ring 21. Said O-ring can be attached, in particular; the fact that it could also be provided directly on the housing instead should be mentioned for the sake of completeness. This variant is likewise simple to produce, highly reliable during use but requires more parts to be mounted and, moreover, entails the risk of standards not being complied with if the sealing ring is later replaced.

In contrast, a variant which is particularly simple to mount is shown at the bottom of FIG. 6. A sealing sleeve 12 which is directly integrally formed on an insert 5 (latching suppression means) is shown here. In this case, the sealing sleeve is injection molded through holes 22 in the collar region in order to create a sealing ring on that side which faces the housing during use. This arrangement is more complicated to produce but permits particularly simple mounting.

What is claimed is:

1. A seal for a plug connector arrangement having a plug which is intended to latch into a standard socket in a releasable manner, wherein the seal is formed with a latching suppression means for permanently preventing the plug from latching in and with a pushing means for pushing the plug, which is not latched in, into its standard contact position, wherein the seal comprises a flexible sealing sleeve which is produced separately from the plug and is slipped over the finished plug, rests against a cable in a sealing manner and further comprises a sealing surface which pushes against a housing when the pushing means is used.

2. The seal as claimed in claim 1 for a plug which has a front block which has contact elements on its lower face and which is provided with a latching means on its upper face.

3. The seal as claimed in claim 1, wherein the latching suppression means stops in a defined position on the latching element of the plug at least in the pushed state.

4. The seal as claimed in claim 3, wherein the pushing means comprises a threaded or bayonet nut which can be turned onto a fastening means on the housing having the socket.

5. The seal as claimed in claim 3, wherein the pushing means has a latching hook engagement means for latching into the housing.

6. A plug connection having a sealing means as claimed in claim 1.

7. An electrical device for use with a seal as claimed in claim 1, wherein a fastening means for the pushing means is provided on the housing.

8. The electrical device as claimed in claim 7, wherein a socket is arranged so that it is not possible to release the plug, which is intended to be latched in, without tools.

9. The seal as claimed in claim 1, wherein the pushing means comprises a threaded or bayonet nut which can be turned onto a fastening means on the housing having the socket.

10. The seal as claimed in claim 1, wherein the pushing means has a latching hook engagement means for latching into the housing.

11. A plug connector comprising:

a plug formed with a cable;

a housing that has a socket for receiving the plug in a releasable manner;

a latching suppression member for permanently preventing the plug from latching closed and for engagement with the plug;

a seal formed as a flexible sealing sleeve which is produced separately from the plug and is for positioning over the finished plug;

said flexible sealing sleeve having one end formed about the cable and an opposite end;

a pushing member in the form of a securing element disposed at the opposite end of the flexible sealing sleeve at a sealing surface of the flexible sealing sleeve and for engagement with the housing.

12. The plug connector as claimed in claim 11, wherein the pushing means comprises a threaded or bayonet nut which is engaged onto a fastening means on the housing.

13. The plug connector as claimed in claim 11, wherein the pushing means has a latching hook engagement means for latching into the housing.

* * * * *